US005562579A

United States Patent [19]

Sheikowitz

[11] Patent Number: 5,562,579

[45] Date of Patent: Oct. 8, 1996

[54] LEG LIFT UNIT

[75] Inventor: Jeffrey Sheikowitz, Florida, N.Y.

[73] Assignee: Legacy International, Inc., Florida, N.Y.

[21] Appl. No.: 396,298

[22] Filed: Feb. 28, 1995

[51] Int. Cl.[6] ..... A63B 23/04

[52] U.S. Cl. ..... 482/138; 482/97; 482/104; 482/137; 482/139

[58] Field of Search ..... 482/92–94, 97–104, 482/133–138, 142, 139

[56] References Cited

U.S. PATENT DOCUMENTS

| | | | |
|---|---|---|---|
| D. 326,696 | 6/1992 | Bogaczyk et al. . | |
| D. 330,238 | 10/1992 | Desiderio . | |
| 4,546,968 | 10/1985 | Silberman . | |
| 4,598,908 | 7/1986 | Morgan . | |
| 4,634,127 | 1/1987 | Rockwell | 482/138 |
| 4,635,934 | 1/1987 | Roethke . | |
| 4,732,380 | 3/1988 | Maag | 482/134 |
| 4,746,114 | 5/1988 | Grider . | |
| 4,749,190 | 6/1988 | Jennings . | |
| 4,765,616 | 8/1988 | Wolff . | |
| 4,784,384 | 11/1988 | Deola | 482/138 |
| 4,793,608 | 12/1988 | Mahnke et al. . | |
| 4,804,179 | 2/1989 | Murphy et al. | 482/138 |
| 4,861,025 | 8/1989 | Rockwell | 482/142 |
| 4,907,798 | 3/1990 | Burchatz | 482/104 |
| 5,069,447 | 12/1991 | Snyderman et al. | 482/137 |
| 5,082,259 | 1/1992 | Gonzalez . | |
| 5,160,305 | 11/1992 | Lin . | |
| 5,277,685 | 1/1994 | Gonzales | 482/134 |
| 5,350,346 | 9/1994 | Martinez | 482/104 |

FOREIGN PATENT DOCUMENTS

| | | |
|---|---|---|
| 0208208 | 1/1987 | European Pat. Off. . |
| 2065482 | 7/1981 | United Kingdom . |

*Primary Examiner*—Richard J. Apley
*Assistant Examiner*—Victor K. Hwang
*Attorney, Agent, or Firm*—Lowe, Price, LeBlanc & Becker

[57] ABSTRACT

An improved leg lift unit includes three sets of exercising and/or support pads for facilitating various exercise regimens. A first set of exercising pads is mounted to a pivoting leg member to facilitate leg lift exercises. A second set of exercise pads are mounted to a body of the unit to provide support for an exerciser in various positions. A vertically adjustable support pad assembly is provided which can be positioned to clamp a user's legs or thighs when doing leg lift exercises. The vertically adjustable support pad assembly can also be used in arm curl exercises in connection with a bar rest mounted to the pivoting leg member.

18 Claims, 2 Drawing Sheets

LEG LIFT UNIT

FIELD OF THE INVENTION

The present invention is directed to an improved leg lift unit for use with an exercise apparatus.

BACKGROUND ART

The use of leg lift units in conjunction with an exercise apparatus such as an exercise bench is well known in the prior art.

U.S. Pat. No. 4,546,968 to Silberman discloses an adjustable bench mounted leg lift exerciser which comprises an L-shaped member made of a first arm and a second arm substantially perpendicular to the first arm. An ankle engaging member is fixed to each of the arms. The L-shaped member pivots about a pivot point to facilitate leg exercises.

U.S. Pat. No. 4,749,190 to Jennings shows a leg lift unit similar to the type described in the Silberman patent.

U.S. Pat. No. 4,793,608 to Mahnke et al. discloses a multipurpose exercise machine which includes a leg lift unit as shown in FIGS. 6, 8 and 9. This leg lift unit includes a member pivotally attached to the bench frame.

The prior art leg lift units still suffer from the inability to accommodate a variety of leg and arm exercises. The prior art devices also fail to provide support for a portion of an exerciser's body during the exercise routine.

In response to the disadvantages of the prior art noted above, the present invention provides an improved leg lift unit which accommodates both arm and leg exercises and provides needed support to an exerciser during use.

SUMMARY OF THE INVENTION

Accordingly, it is a first object of the present invention to provide a leg lift unit which accommodates both leg and arm exercises.

Another object of the present invention to provide a leg lift unit which provides support for an exerciser during an exercising routine.

It is a further object of the present invention to provide a leg lift unit which includes retaining means for an exerciser's legs during exercising.

Other objects and advantages of the present invention will become apparent as a description thereof proceeds.

In satisfaction of the foregoing objects and advantages, the present invention provides a leg lift unit which is an improvement over prior art leg lift units which are mountable to an exercise apparatus and include a leg member pivotally mounted to the exercise apparatus, the leg member including a first pair of opposing exercising pads and means for retaining weights thereon.

According to the invention, the improved leg lift unit body includes a second leg member having a second pair of opposing exercising pads mounted to an end thereof. The second leg member is vertically adjustable with respect to the leg lift unit body for positioning of said second pair of exercising pads for an exercising regimen or use.

The inventive leg lift unit may also include a third pair of opposing exercising pads and a barbell rest, both fixedly mounted to the leg lift unit body. Preferably, the second leg member telescopes within a channel in the leg lift unit body for vertical adjustability. The second leg member can be secured in any given position, preferably, through the use of a locking pin assembly.

The vertically adjustable exercising pads can be used as a body support when an exerciser is using the first leg member in a standing position. Alternatively, the second pair of exercising pads can clamp the thigh of an exerciser in a seated position.

The leg lift unit also facilitates arm exercises by using the second or uppermost pair of exercising pads and dumbbells or a barbell system.

The leg lift unit is adaptable to be mounted to any exercise apparatus, e.g., an exercise bench. Alternatively, the unit can be utilized with an exercise apparatus with stacked weights using cables and pulleys.

BRIEF DESCRIPTION OF THE DRAWINGS

Reference is now made to the drawings of the invention wherein.

DESCRIPTION OF THE PREFERRED EMBODIMENTS

Figure 1:
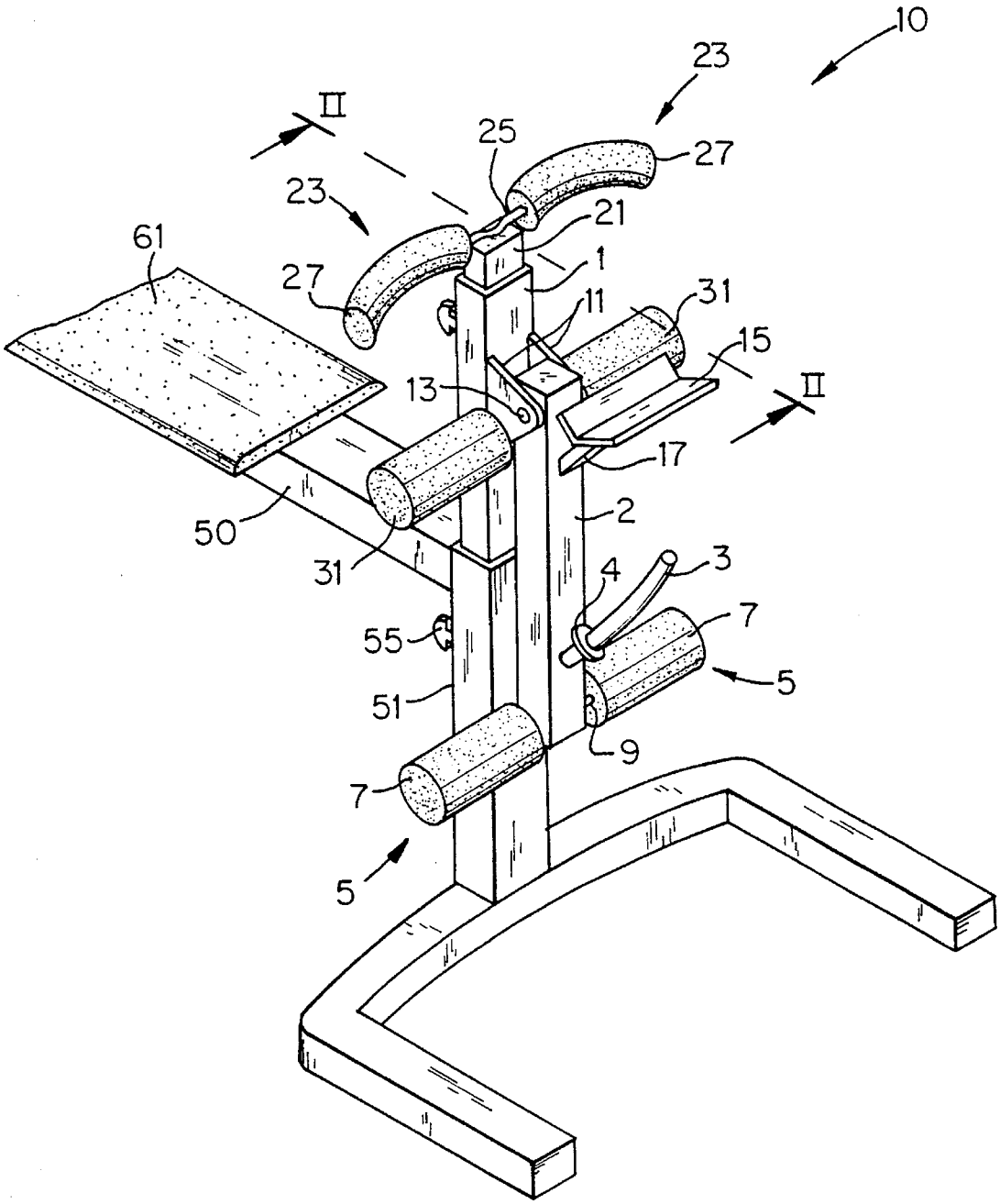
FIG. 1 is a perspective view of the inventive leg lift unit mounted to an exercise bench.

With reference to FIG. 1, the inventive leg lift unit is generally designated by the reference numeral 10 and is seen to include a leg lift body 1 having a leg member 2 pivotally mounted thereto. The leg member 2 includes a weight stanchion 3 mounted at an end thereof. The weights stanchion 3 includes a stop 4 which supports weights (not shown) mounted on the stanchion 3.

The end of the pivoting leg member 2 includes a pair of exercising pads 5. Typically, the pads comprise a resilient portion 7 which surrounds a bar 9, the bar mounted to the leg member 2 in a conventional fashion.

The leg member 2 is pivotally attached to the leg unit body 1 by a pair of flanges 11 and pivoting bolt 13. The leg member 2 is positioned between the flanges 11 with the pivoting bolt 13 extending through openings in the flanges and leg member (not shown) to achieve the pivoting movement.

The leg member 2 also includes a bar rest 15 which is secured to the leg member 2 via the support 17. The bar rest 15 facilitates exercises such as arm curls or the like which will be described below.

Figure 2:
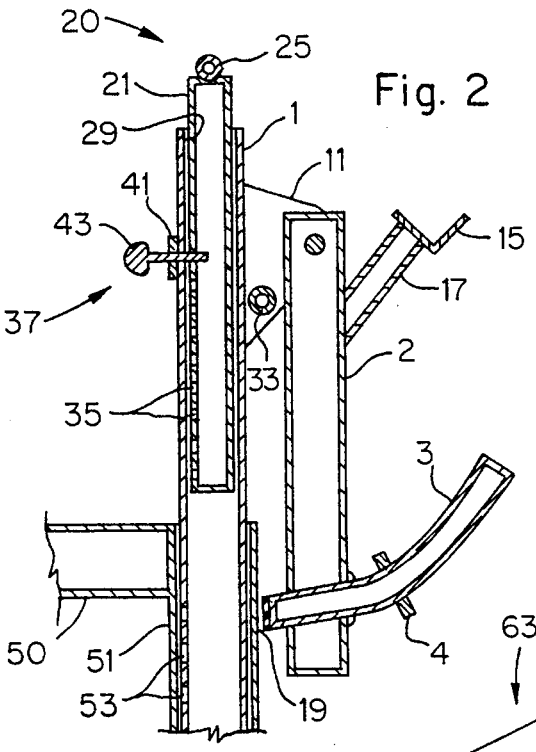
FIG. 2 is a cross-sectional view along the line II—II of FIG. 1.

With reference now to FIGS. 1 and 2, the leg member 2 also includes a bumper in the form of a resilient pad 19 mounted on the end of the weight stanchion 3. As seen from FIG. 2, the weight stanchion 3 can be tubular in form to extend through the leg member 2 to facilitate both weight and resilient pad 19 mounting. Of course, the pad 19 could be mounted to the body 1 or elsewhere on the leg member 2.

The leg lift unit 10 also includes a support pad assembly designated by the reference numeral 20. The support pad assembly comprises a leg 21 and a pair of opposing support pads 23. Again, the support pads 23 can be formed using an elongated tubular member 25 mounted to the top end of the leg 21, the tubular member 25 including the resilient portions 27.

The leg 21 is sized to slide or telescope within the channel 29 formed by the leg lift unit body 1. The function of the support pad assembly 20 will be described in further detail below.

The leg lift unit 10 also includes a pair of opposing middle exercising pads 31 which are similar in construction to the pads 5 and 23. A tubular arm 33 is shown in FIG. 2 for receiving the resilient portions forming part of the middle exercising pads 31.

With reference now to FIG. 2, the support pad assembly 20 is vertically adjustable so as to position the support pads 27 in a desired location for a given exercise. The support pads 23 are preferably curved or arcuate in shape to facilitate clamping of an exerciser's legs during leg lift exercises.

The leg member 21 includes a plurality of openings 35 therein. In conjunction with these openings, the leg lift unit body 1 includes a locking pin assembly 37 which is designed to secure the leg member 21 in a given position with respect to the leg lift unit 1.

One embodiment of the locking pin assembly is depicted in FIG. 2 wherein a nut is attached to the leg lift unit body 1. A threaded pin 43 extends through the nut 41 and an opening in the leg lift unit 1 to engage one of the openings 35 in the leg 21. The pin 43 can be threadably tightened to the nut 41 to secure the leg 21 in given position.

To adjust the position of the leg 21, the pin 43 can be unscrewed and the leg 21 moved vertically up or down for pin engagement in a different opening.

Of course, other means may be used to secure the leg 21 in a given position such as a spring loaded pin, a pin that extends through both faces of the leg lift unit 1 or the like. For universal adjustment, the pin 43 can be tightened against the leg 21 to secure it in a vertical position.

With reference again to FIGS. 1 and 2, the leg lift unit 1 can be mounted to any exercise apparatus including an exercise bench 50 as shown in FIGS. 1 and 2. In this embodiment, the exercise bench 50 includes a hollow leg 51 which is sized to receive a portion of the leg lift unit body 1. In this embodiment, the leg lift unit body 1 includes apertures 53 which facilitate vertical adjustments of the leg lift unit body 1 using the pin assembly 55 as the same manner as that described above.

Of course, alternative mounting arrangements can be utilized to secure the leg lift unit body 1 to an exercise bench 50. For example, the leg lift unit body 1 could merely slide within the hollow leg 51 and rest against a stop therein. Alternatively, the leg lift unit body 1 could be fastened using conventional techniques to the exercise bench 50.

Alternatively, the leg lift unit body could be attached to an exercise apparatus employing cables and pulleys in conjunction with weights for exercise use. In this embodiment, the weights stanchion 3 could be replaced by a cable/pulley and weight apparatus.

Figure 3:
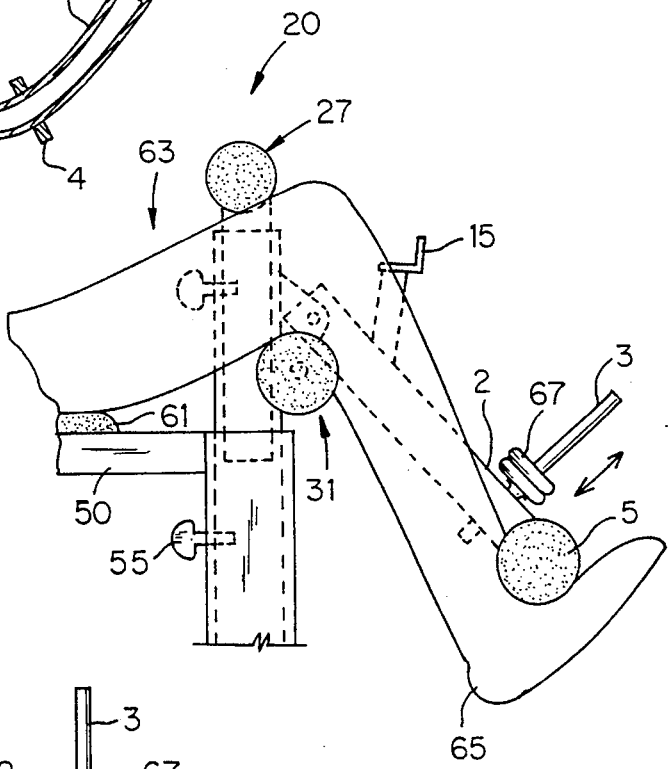
FIG. 3 is side view of the leg lift unit in a first exemplary use.
Figure 4:
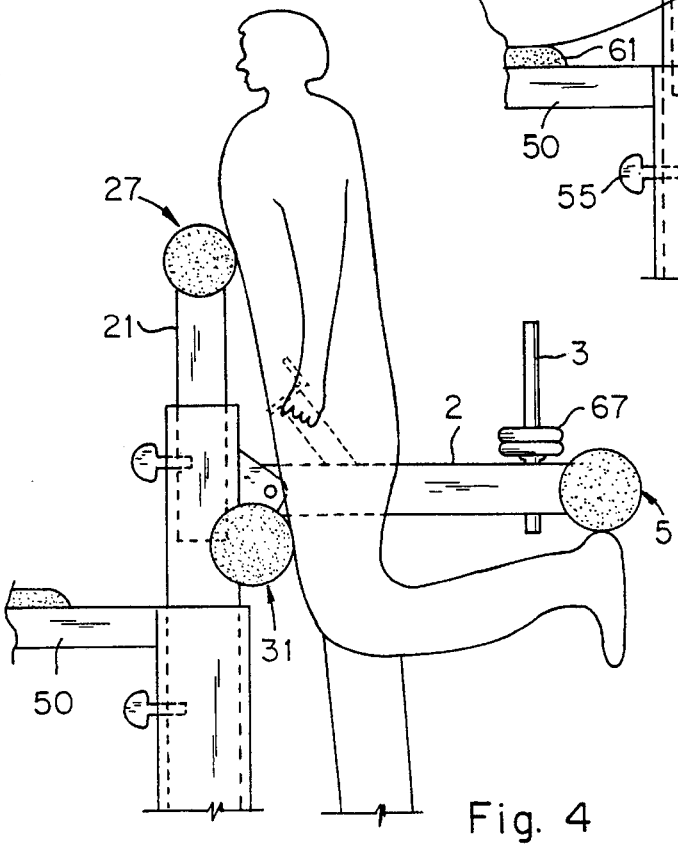
FIG. 4 is a side view of the leg lift unit in a second exemplary use.

FIGS. 3 and 4 show two exemplary uses of the inventive leg lift unit 10. In FIG. 3, an exerciser is seated on a bench 61 of the exercise bench 50 with the exerciser's legs resting on the exercising pads 31. The exerciser's ankles 65 are positioned beneath the exercising pads 5. The support pad assembly 20 is vertically adjusted such that the support pads 27 clamp the exercises thighs in position to facilitate the leg lifting exercises. In this exercise, as indicated by the arrows in FIG. 3, the leg member 2 is pivoted with weights 67 positioned on the weight stanchion 3.

With reference to FIG. 4, the support pads 27 and middle pads 31 are used to support an exerciser when standing and facing the exercise bench 50. In this exercise, one leg is raised up against the exercising pads 5 while the other leg remains on a floor. The leg member 2 is raised a given number of times followed by a second set of exercises with the other leg.

With reference again to FIG. 3, the support pad assembly 20 can be vertically adjusted to accommodate arm curls or the like. In this exercise, an exerciser's elbow or forearm would rest on the support pads 27 while doing arm curls using a barbell or dumbbells. Before, during or after the arm curl exercises, the bar rest 15 can support the barbell or dumbbell.

As such, an invention has been disclosed in terms of preferred embodiments thereof which fulfill each and every one of the objects of the present invention as set forth hereinabove and provides a new and improved leg lift unit.

Of course, various changes, modifications and alterations from the teaching of the present invention may be contemplated by those skilled in the art without departing from the intended spirit and scope thereof. Accordingly, it is intended that the present invention only be limited by the terms of the appended claims.

I claim:

1. In a leg lift unit having a pivotal first leg member, said pivotal first leg member including a first pair of opposing exercising pads and means for retaining weights, the improvement comprising a leg lift unit body to which said pivotal first leg is pivotally mounted thereto, said leg lift unit body having a second leg member having a second pair of opposing exercising pads mounted to an end thereof and a third pair of opposing exercising pads fixedly mounted to said leg lift unit body, said second leg member being independent of said pivotal first leg member and vertically adjustable with respect to said leg lift unit body for positioning of said second pair of exercising pads for exercising use.

2. The leg lift unit of claim 1 wherein said leg lift unit body further comprises a channel therein and said second leg member is sized to slide within said channel for said vertical adjustability.

3. The leg lift unit of claim 1 further comprising a barbell rest mounted to said first leg member.

4. The leg lift unit of claim 1 wherein said second leg member has a plurality of openings along a length thereof and said leg lift unit body includes a pin assembly wherein a pin of said pin assembly engages one of said openings to lock said second leg member for exercising.

5. The leg lift unit of claim 1 wherein each of said first and second pairs of opposing exercising pads comprises an arm surrounded by a resilient material.

6. The leg lift unit of claim 1 wherein each of said first, second and third pairs of opposing exercising pads comprises an arm surrounded by a resilient material.

7. The leg lift unit of claim 1 wherein said second leg member is generally parallel to said first leg member when said first leg member is at rest.

8. The leg lift unit of claim 1 further comprising a resilient stop mounted between said leg lift unit body and said first leg member.

9. The leg lift unit of claim 1 wherein said third pair of opposing exercising pads are mounted to said leg lift unit body so as to be spaced between said first pair of opposing exercising pads when at rest and said second pair of opposing exercising pads.

10. The leg lift unit of claim 1, wherein said leg lift unit and said leg lift unit body form a unitary assembly to be mounted to an exercise apparatus.

11. The leg lift unit of claim 1, wherein a longitudinal axis of said second leg member is disposed vertically so that said second leg member is vertically adjustable along said vertically disposed longitudinal axis.

12. In a leg lift unit having a pivotal first leg member, said pivotal first leg member including a first pair of opposing exercising pads and means for retaining weights the improvement comprising:

a) a leg lift unit body to which said pivotal first leg is pivotally mounted thereto, said leg lift unit body having a second leg member having a second pair of opposing exercising pads mounted to an end thereof, said second leg member being independent of said pivotal first leg member and vertically adjustable with respect to said leg lift unit body for positioning of said second pair of exercising pads for exercising use;

b) a third set of opposing exercising pads fixedly mounted to said leg lift unit body;

c) said means for retaining weights comprising a weight stanchion mounted to said first leg member;

d) a bumper mounted to said first leg member; and e) a bar rest mounted to said first leg member.

13. The leg lift unit of claim 12 wherein each of said second pair of opposing exercising pads are curved in shape.

14. The leg lift unit of claim 13 further comprising a flange and pin arrangement, said flange mounted to said leg lift unit body and said pin extending through said flange and said first leg member for said pivoting mounting.

15. The leg lift unit of claim 12 wherein said second leg member is vertically adjustable by a pin removable extensible through a portion of both said leg lift unit body and said second leg member for locking said second leg member in a given position.

16. The leg lift unit of claim 12 wherein said leg lift unit and said leg lift unit body form a unitary assembly to be mounted to an exercise apparatus.

17. The leg lift unit of claim 12, wherein said leg lift unit body further comprising a channel therein and said second leg member is sized to slide within said channel for said vertical adjustability.

18. The leg lift unit of claim 12, wherein a longitudinal axis of said second leg member is disposed vertically so that said second leg member is vertically adjustable along said vertically disposed longitudinal axis.

* * * * *